US005090067A

United States Patent [19]

Cogdill

[11] Patent Number: 5,090,067

[45] Date of Patent: Feb. 25, 1992

[54] BIDET APPARATUS

[76] Inventor: Cletus V. Cogdill, 18140 Gallineta St., Rowland Heights, Calif. 91748

[21] Appl. No.: 650,750

[22] Filed: Feb. 5, 1991

Related U.S. Application Data

[63] Continuation-in-part of Ser. No. 484,408, Feb. 23, 1990, abandoned, which is a continuation-in-part of Ser. No. 236,607, Aug. 25, 1988, abandoned.

[51] Int. Cl.[5] ..... A47K 3/00

[52] U.S. Cl. ..... 4/420.2; 4/420.4; 4/448

[58] Field of Search ..... 4/420.1–420.5, 4/443–448

[56] References Cited

U.S. PATENT DOCUMENTS

| | | | |
|---|---|---|---|
| 2,364,491 | 12/1944 | Triadou | 4/420 A X |
| 2,762,058 | 9/1956 | Hurko | 4/420.5 |
| 3,462,766 | 8/1969 | Merkel, Jr. | 4/420.2 |
| 3,662,407 | 5/1972 | Colucci | 4/420.2 |
| 3,914,804 | 10/1975 | Schrader et al. | 4/420.2 X |
| 3,947,899 | 4/1976 | Robinson et al. | 4/420.2 X |
| 4,371,993 | 2/1983 | Patrick | 4/448 |
| 4,393,525 | 7/1983 | Kondo | 4/420.2 |
| 4,559,651 | 12/1985 | Tanahashi et al. | 4/443 |
| 4,596,058 | 6/1986 | Nourbakhsh | 4/448 |
| 4,759,382 | 7/1988 | Harel | 137/561 A X |

FOREIGN PATENT DOCUMENTS

| | | | |
|---|---|---|---|
| 8102319 | 8/1981 | World Int. Prop. O. | 4/420.4 |

*Primary Examiner*—Henry J. Recla
*Assistant Examiner*—Robert M. Fetsuga
*Attorney, Agent, or Firm*—Boniard I. Brown

[57] ABSTRACT

A bidet apparatus associated with a toilet water tank, has a water tank, an immersion heater to maintain water heated therein, a flexible conduit between the bidet tank and a portable spray head, a pump to pump heated water, and apparatus for recirculating heated water from the spray head through the flexible conduit to the water tank. Several embodiments are disclosed.

33 Claims, 6 Drawing Sheets

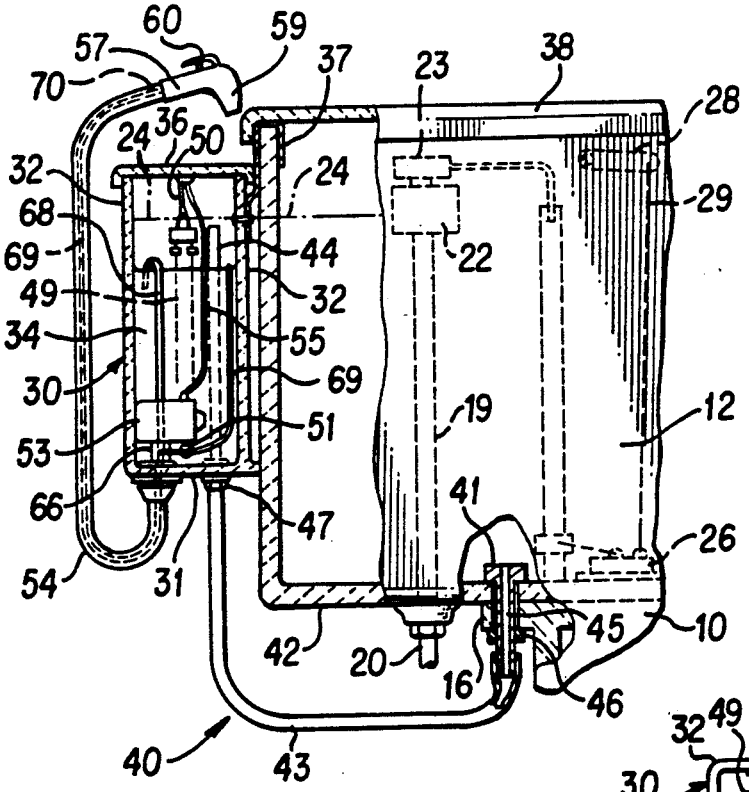
FIG. 3
FIG. 4
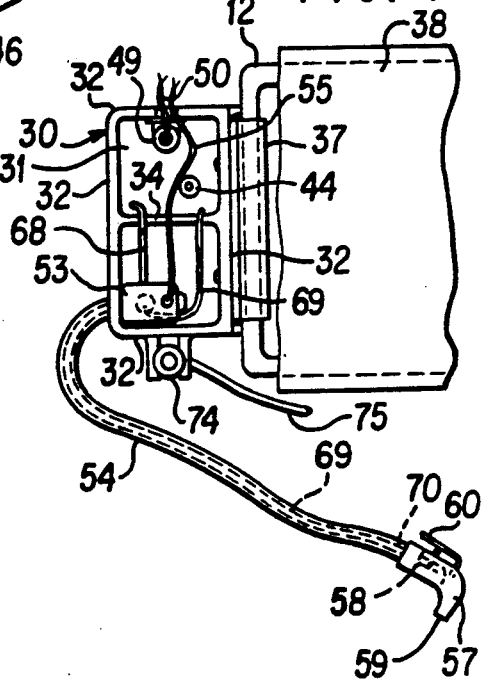
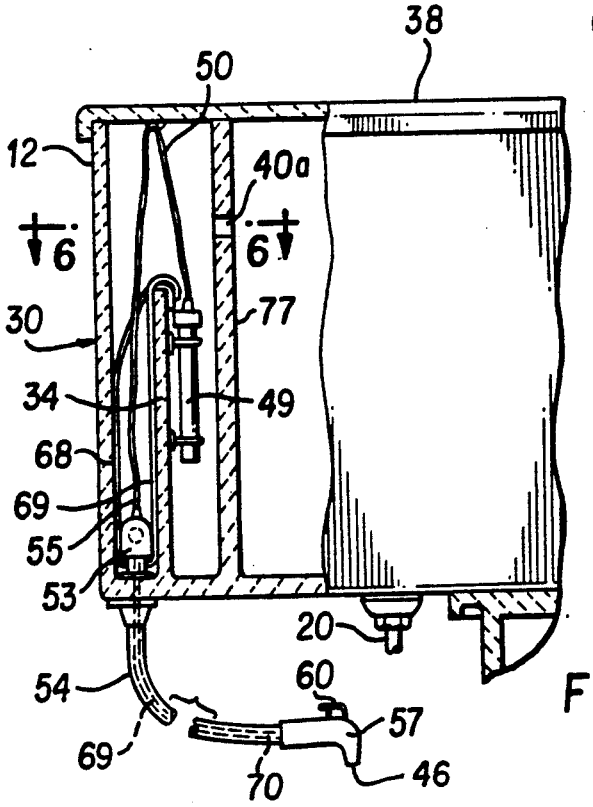
FIG. 5

BIDET APPARATUS

CROSS REFERENCE TO A RELATED PATENT APPLICATION

This application is a continuation-in-part of copending application, Ser. No. 07/484,408 filed on Feb. 23, 1990, now abandoned, which is a continuation-in-part of application Ser. No. 07/236,607 filed on Aug. 25, 1988, now abandoned.

BACKGROUND OF THE INVENTION

This invention relates to a bidet apparatus that can be associated with (or incorporated in) an otherwise conventional toilet.

Prior to my invention others have suggested that toilets can be modified to incorporate a bidet function, i.e., to provide a water spray for cleansing the posterior parts of a person's body using the toilet bowl as receiver for the cleansing liquid (water).

U.S. Pat. No. 2,762,058 to Hurko shows a toilet having a water spray head 55 mounted in a rear surface of the toilet bowl rim 3 to discharge a jet of water forwardly and slightly upwardly to perform a cleansing operation on a person seated on the toilet. Spray head 55 receives its supply of water from an auxiliary chamber 33 formed integrally with a toilet tank 32. A manually-operated valve 39 controls the flow of water from chamber 33 to spray head 55.

The apparatus of Hurko U.S. Pat. No. 2,762,058 has some disadvantages. For example, the water discharged from spray head 55 is cold water; a spray of warm water would be less shocking and otherwise more beneficial to the user. Also, the spray head 55 of the patented device is in a fixed location in the toilet bowl such that the spray water has a fixed trajectory; the water contacts only one specific area of the person's body, rather than multiple distinct areas on the body. The water spray has a specific impingement angle against the body, such that it may not be effective on persons with different anatomical configurations.

U.S. Pat. No. 4,596,058 to Nourbakhsh shows a bidet attachment for a toilet, wherein a portable spray head 80 is supplied with water through a flexible conduit 78 that is connected to an auxiliary water chamber 60. A person seated on the toilet can manipulate the portable spray head to perform a cleansing operation. Water chamber 60 is supplied with separate streams of hot and cold water through lines 62 and 66; separate control valves are associated with the water lines to adjust the respective flows, to thereby control the temperature of the water discharged from chamber 60 into flexible conduit 78.

The Nourbakhsh Patent would require special plumbing connections to provide the separate streams of hot and cold water (lines 62 and 66). Additionally the performance of the apparatus might not be entirely satisfactory, due to the fact that for the first few minutes' operation the hot water line might be relatively cold (until the line had cleared itself of relatively cold water). During the first few minutes' operation the water spray on the person's body might be relatively cold; adjustment of the mixing valves to raise the water temperature could cause the person to be later scalded when the hot water line was cleared of relatively cold water.

The device of the Nourbakhsh Patent includes a specially built water tank. It cannot be a conventional tank with add-on componentry (i.e., a retrofit type installation).

SUMMARY OF THE INVENTION

My invention relates to a bidet attachment for a toilet, wherein a portable water spray head is supplied with heated water having a relatively constant temperature. The water spray temperature is the same during the initial moment of operation as it is at other times during the cleansing process. There is no danger that the person will be scalded.

An important feature of my invention is the fact that no special plumbing connections to the household water supply system are required. I have designed the bidet system so that it receives its water supply from the toilet water tank without any special valves or controls.

My invention may be implemented in the form of an add-on apparatus for use with existing toilets. Alternately the invention may be integrated into a newly designed toilet tank.

BRIEF DESCRIPTION OF THE DRAWINGS

FIG. 3 is a sectional view taken on line 3—3 in FIG. 1.

FIG. 4 is a top plan view of the attachment shown in FIG. 1, with a cover element removed for illustration purposes.

FIG. 5 is a sectional view through another apparatus embodying my invention.

DESCRIPTION OF THE PREFERRED EMBODIMENTS OF THE INVENTION

Figure 2:
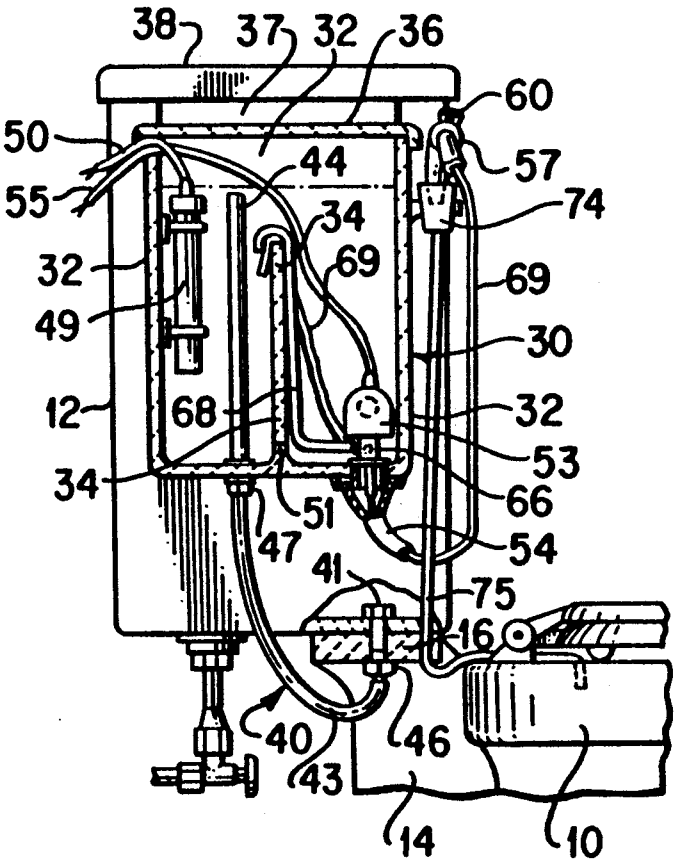
FIG. 2 is a sectional view taken on line 2—2 in FIG. 1.

FIGS. 1 through 4 illustrate a conventional toilet that includes a toilet bowl 10 and water tank 12. Rear portion 14 of the toilet bowl forms a shelf 16 (FIG. 2) that acts as a support for tank 12. Two laterally-spaced bolts extend through the bottom wall of the tank and shelf 16 to rigidly mount the tank on the bowl.

Under conventional practice the mounting bolts are standard solid elements having non-circular heads and threaded shanks. In the practice of my invention I replace one of the standard bolts with a special hollow bolt having a water passage extending axially therethrough. FIG. 3 illustrates the general construction of the special bolt. The other mounting bolt (not shown) is of standard solid construction.

The interior componentry with water tank 12 is the usual hardware found in existing toilet tanks. For illustration purposes I show in FIG. 3 a conventional filler pipe 19 connected to a cold water supply pipe 20. Annular float 22 surrounds pipe 19 for opening or closing a standard valve 23 mounted atop pipe 19, according as the water level in the tank is below or at the design level, designated by numeral 24 in FIGS. 2 and 3.

FIG. 3 shows a flapper valve 26 for controlling water flow from tank 12 into bowl 10. A conventional handle 27 (FIG. 1) is connected to a lever 28 (FIG. 3), which has a chain-type connection 29 with valve 26, whereby operation of handle 27 lifts valve 26 from the subjacent valve seat to permit gravitational flow of water into bowl 10. The valve apparatus is conventional.

My invention is more particularly concerned with a bidet apparatus associated with an otherwise conventional toilet. The bidet apparatus of FIGS. 1 through 4 comprises a ceramic chamber means 30 formed separately from water tank 12, such that the separate chamber means can be attached to, or removed from, the tank without affecting the tank performance. The bidet apparatus can be marketed and supplied to the homeowner as a separate add-on device suitable for use with any standard toilet. Also, the homeowner can remove the bidet and take it with him should he move to a new home.

The ceramic chamber means 30 comprises an upright (open-topped) container having a bottom wall 31 and four upstanding side walls 32. Additionally, a transverse partition 34 extends upwardly from bottom wall 31 to a point some distance below the aforementioned water level 24. A removable cover 36 closes the upper end of the container.

Chamber means 30 can be readily attached alongside water tank 12 by means of a metal hook structure 37 rivetted or otherwise secured to one of the side walls 32. As seen in FIG. 3, the hook structure 37 engages an upper edge of one wall of tank 12 to removably suspend chamber means 30 from the water tank. The hook structure is relatively thick, as viewed in FIG. 4, but relatively thin as viewed in FIG. 3 so that it does not offer an obstruction to placement of the conventional cover 38 on tank 12. Chamber means 30 can be removed from tank 12 when desired or necessary.

Water is supplied to chamber means 30 through a passage structure indicated generally by numeral 40 (FIG. 3). Passage structure 40 comprises a hollow mounting bolt 41 extending through the bottom wall 42 of tank 12, a flexible hose 43 extending leftwardly from bolt 41 (FIG. 3), and standpipe 44 extending vertically within chamber means 30.

Hollow bolt 41 comprises a non-circular head and a hollow (tubular) shank that forms an axial water passage 45. A portion of the tubular shank is threaded to accommodate a nut 46, whereby the bolt-nut assembly acts as a connecting means for attaching water tank 12 to toilet bowl 10. The end of hose 43 telescopes onto the extreme lower end of the bolt tubular shank, such that water can flow downwardly through the bolt into hose 43 (and eventually upwardly into standpipe 44).

The lower end of standpipe 44 can be flanged and threaded to receive a mounting nut 47 in a fashion similar to the structure of bolt 41. The left end of hose 43 telescopes onto the extreme lower end of the standpipe 44, whereby water can flow from the hose upwardly into pipe 44.

During the process of filling tank 12 some water is automatically diverted from the tank into hollow bolt 41. As tank 12 fills to reach water level 24 the associated chamber means 30 is similarly filled to the same level 24. Once the chamber means 30 is filled it cannot be emptied back through passage structure 40; the upper open end of pipe 44 is at, or just below, the water level 24 so that water remains in chamber means 30 up to the level established by pipe 44 even though tank 12 may be emptied any number of times to flush the toilet bowl.

Pipe 44 is preferably dimensioned so that its upper end is only slightly below the water level 24; this ensures that the level in chamber means 30 remains substantially constant between a "high" level established by float 22 and a "low" level established by pipe 44 (when tank 12 is emptied).

The bidet apparatus includes means for heating the water in chamber means 30. Preferably the heating means is a low wattage immersion heater of the type used in aquariums for water heating purposes. The immersion heater can comprise an elongated tubular sheath 49 having a resistance heater wire extending therewithin for substantially the entire sheath length; crushed ceramic insulation occupies the internal space between the resistance heater wire and the protective sheath. The heater will have electrical cable means 50 extended therefrom for connection to a 110 volt electrical source (wall outlet), not shown. Preferably the heater operates continously.

The tubular heater is preferably supported in an upright vertical position as shown in FIGS. 2 and 3. The reasoning is that since the heater surface extends along the entire heater length the heater will be able to establish a relatively great water temperature differential from the low end of the heater to the upper end of the heater (each incremental length of the heater will produce a certain temperature rise in the surrounding water film). The water temperature differential will produce a water upflow along the heater surface that will promote a desired circulation of water through chamber means 30, and a more thorough heating of the entire water mass. Also, a vertical disposition of the heater enables a relatively long heater to be used without unduly increasing the lateral (horizontal) dimension of chamber means 30. The heater can occupy a substantial portion of the vertical dimension of chamber means 30.

The aforementioned partition 34 may have some advantage in chanelling the heated water into near proximity to heater 49 (rather than spreading laterally outwardly away from the heater). A small hole 51 may be formed in the partition to promote a minor water upflow into the vicinity of the heater. The heater is continously energized to maintain the entire water mass in a human-comfort range (e.g. 80 to 90 degrees Farenheit).

A small electrically-operated water pump 53 is located in chamber means 30 for continuously pumping heated water into a flexible conduit 54. At its free end the flexible conduit carries a water spray head 57. Disposed within the spray head is a conventional valve 58 for controlling water flow out of the nozzle opening 59; a depressible trigger arm 60 is provided for opening the valve.

Flexible conduit 54 is sufficiently long that a person sitting on the toilet seat can manipulate and actuate spray head 57 to perfom a bidet type cleansing operation; the toilet bowl acts as a receiver for cleansing liquid.

Figure 11:
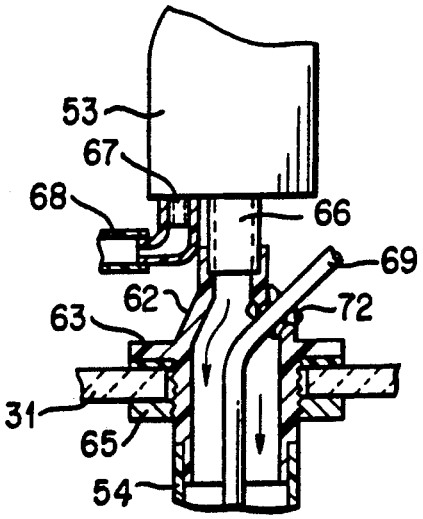
FIG. 11 is an enlarged fragmentary sectional view through a structural detail used in the FIG. 2 arrangement.

Pump 53 can be connected to conduit 54 in various different ways. FIG. 11 illustrates the connection mechanism as an annular fitting 62 having a flange 63 seated on a gasket on the upper surface of the chamber bottom wall 31. A nut 65 is threaded onto a threaded portion of the fitting to secure the fitting to wall 31; conduit 54 telescopes onto the lower tubular end of the fitting.

Pump 53 is a conventional hardware item having a built-in electric motor that is supplied with current through insulated lead wires 55 (FIG. 2). The pump includes a water outlet tube 66 that fits into a socket in the upper end of fitting 62. A pump inlet tube 67 connects to a tubular right angle bend which telescopically receives one end of a flexible tube 68.

An important feature of my invention resides in a water recirculation structure that continually maintains the water at spray head 57 in a heated condition. The water circulation feature maintains the water in conduit 54 in a heated condition. Additionally, the water circulation feature keeps the heated water moving, which retards the formation of bacterial (that could form in heated stagnant water).

The water recirculation mechanism comprises a flexible tube 69 extending along (within) conduit 54 from fitting 62 to a point near spray head 57. As seen in FIG. 3, tube 69 has an open end 70 near spray head 57, whereby when the spray head valve is closed the heated water flowing through conduit 54 is caused to flow into and through the tube 69 in a reverse direction, i.e. toward fitting 62.

Tube 69 can extend through a rubber gromment 72 on one wall of fitting 62 and then upwardly toward the upper edge of partition 34. The extreme end of tube 69 hooks over the upper edge of partition 34 to discharge water into the zone near heater 49. The recirculated water thereby undergoes a heating action after it leaves tube 69. The aforementioned tube 68 also hooks over the upper edge of partition 34, whereby water admitted to tube 68 tends to be in a heated condition even though water in other areas of chamber means 30 might not be fully heated.

With the spray head valve closed the water flow circuit comprises tube 68, pump 53, conduit 54 (toward spray head 57), back through tube 69 (away from the spray head), and into the chamber space near heater 49. Pump 53 operates continuously so that the water in conduit 54 is always in a heated condition. When spray head valve 58 is opened the water flowing through nozzle 57 will be in a heated condition from the moment the valve is opened. There will be no "cold" period that might otherwise be needed to clear conduit 54 of cold water.

During the period when the spray head valve is held open the water in chamber means 30 will be pumped out of the chamber means. However as the water level in the chamber means is lowered new water will be admitted to the chamber means via passage 40 (i.e., bolt 41, hose 43, and standpipe 44). Heater 49 will heat the new water as it emerges from standpipe 44.

When spray head 57 is not in use it is stored (supported) in a funnel-like holder 74 carried on chamber means 30. A drain tube 75 extends downwardly from holder 74 to drain any residual water from spray head 57 into toilet bowl 10.

FIGS. 1 through 4 represent one preferred form that the invention can take. FIGS. 5 through 10 illustrate other possible forms. Each of the illustrated arrangements operates in essentially the same fashion. Similar reference numerals are used in the several figures to designate similar component parts.

Figure 6:
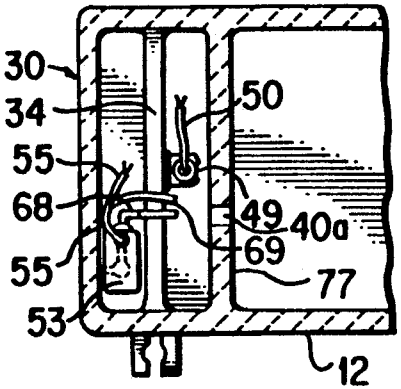
FIG. 6 is a sectional view on line 6—6 in FIG. 5.

FIGS. 5 and 6 show an arrangement wherein chamber means 30 is formed as an integral part of the water tank structure; the chamber means and water tank have a common wall 77 therebetween.

Passage structure 40 (FIG. 3) is replaced by a hole **40*a* in an upper portion of common wall 77. Hole 40*a* functions as a passage to feed water from tank 12 into chamber means 30 when the tank fills to the level of hole 40*a*. Hole 40*a*** is required to be below (and preferably only slightly below) the water level established by the float in the water tank.

The arrangement of FIGS. 5 and 6 functions in essentially the same fashion as the arrangement of FIGS. 1 through 4. Both arrangements provide for recirculation of the heated water through flexible conduit 54.

Figure 1:
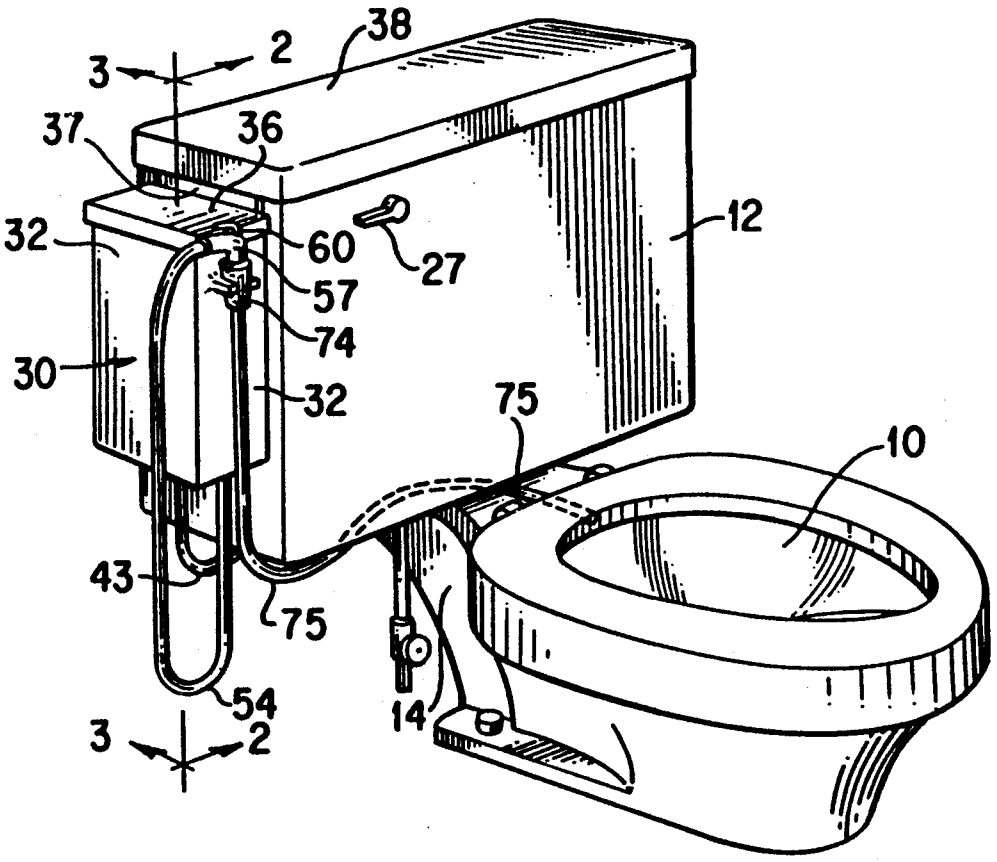
FIG. 1 is a perspective view of a toilet having a bidet attachment thereon constructed according to the teachings of my invention.
Figure 7:
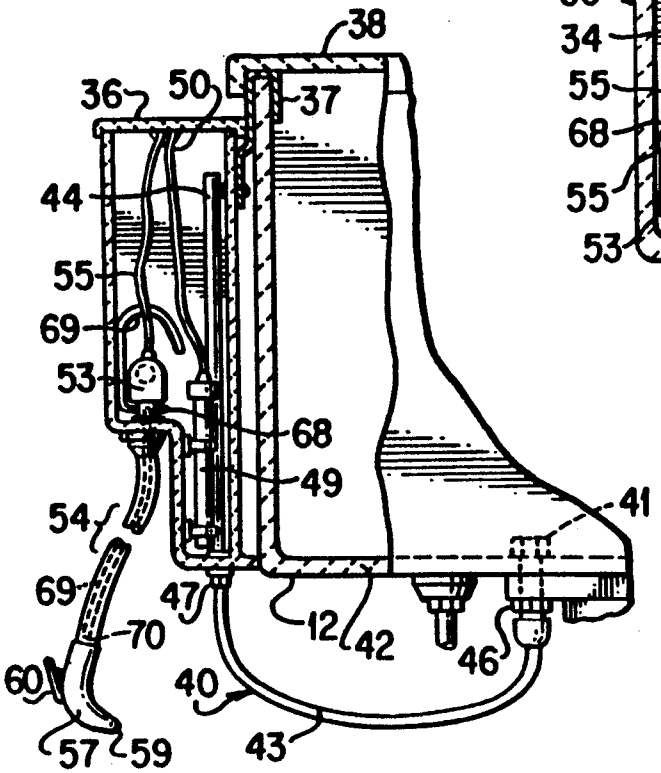
FIG. 7 is a sectional view taken in the same direction as FIG. 5, but illustrating another form that my invention can take.

FIG. 7 illustrates an arrangement that is similar in some respects to the FIG. 1 arrangement. The passage structure from the water tank to the chamber means is the same as passage structure 40 shown in FIG. 3. Also, the chamber attachment means is similar to attachment means 37 shown in FIGS. 3 and 4. The FIG. 7 arrangement lacks a partition (similar to partition 34). Operationally the arrangement of FIG. 7 is essentially the same as that of FIGS. 1 through 4. Heater structure 49 is located in a narrow well so that water to be heated is confined against lateral movement away from the heater. This promotes a thermal upflow of heated water.

Figure 8:
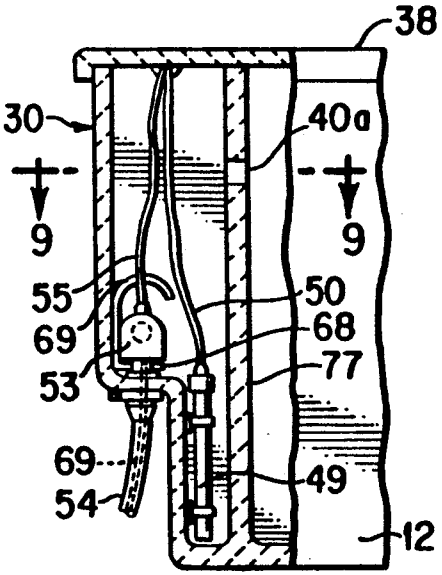
FIG. 8 illustrates a variant of the structure shown in FIG. 7.
Figure 9:
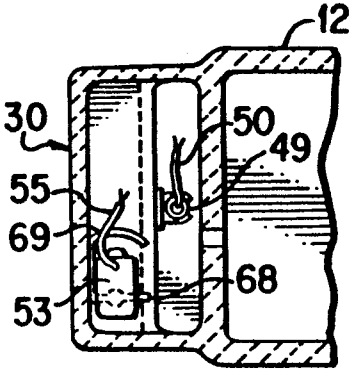
FIG. 9 is a sectional view on line 9—9 in FIG. 8.

FIG. 8 and 9 illustrate an arrangement that is similar to FIG. 7 except that the chamber means is constructed as an integral part of the water tank. Also, the passage between the water tank and the chamber means takes the form of a small hole **40*a* in common wall 77. In this respect the FIG. 8 arrangement is similar to the FIG. 5** arrangement.

Figure 10:
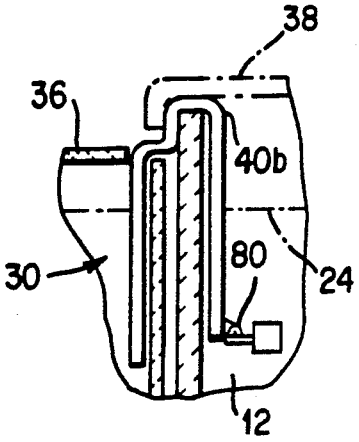
FIG. 10 illustrates a water passage structure that can be used in the apparatus shown in FIG. 7.

FIG. 10 illustrates a structural detail that can be utilized in the overall arrangement shown in FIG. 7 in lieu of passage structure 40.

FIG. 10 shows a passage component **40*b* that comprises U-shaped tube adapted to be manually installed with one leg thereof within the water tank 12 and with the other leg extending downwardly within chamber means 30. A flapper-type float valve 80** is carried on the lower end of one leg of the U-shaped tube.

At the time of initial installation tank 12 is filled to some normal level 24; chamber means 30 is filled to a level at or near level 24. Then the U-shaped tube **40*b* is filled with water and turned over (inverted) and installed in the FIG. 10 position (without allowing the water to escape from tube 40*b*). Float valve 80 will open so that water in tank 12 will be drawn through tube 40*b* into chamber means 30 by a suction effect (assuming more water needs to be added to chamber means 30). When the tank and chamber means 30 are both filled float valve 80** will be open because of the buoyant effect of the float.

Each time tank 12 is emptied float valve 80 will close to keep tube 40*b* filled with water. When the bidet apparatus is in use chamber means 30 will tend to be emptied. However, as the water level in chamber means 30 falls below the water level in tank 12 the pressures at the open ends of the tube 40*b* legs will become unbalanced; float valve 80 will open so that water will be drawn (sucked) from tank 12 through tube 40*b* and into chamber means 30, to thereby maintain an essentially constant water level therein.

With the arrangements shown in FIGS. 1 through 11, it is possible under some conditions to have a relatively cool water temperature in chamber means 30 and in flexible conduit 54. Thus, if spray head 57 is held open for a relatively long period of time, the water initially in chamber means 30 is replaced with new cool water from the toilet tank. This undesirable condition is more likely to occur if the immersion heater 49 has a lower heat output than the heat input required to warm the cool water coming into the chamber means through passage structure 40 or 40*a* or 40*b*.

FIGS. 12 through 18 illustrate structures for avoiding a cool water condition in flexible conduit 54. With the arrangements shown in FIGS. 12 through 18, an automatic valve means is incorporated into a passage structure 40*c*, such that when spray head 57 is in use, there is no inflow of cold water from the toilet tank into chamber means 30. Assuming that heater 49 is able to initially achieve a warm water condition in chamber means 30, then the person using the bidet apparatus will be able to use one complete filling of heated water in chamber means 30 without facing the difficulty that the water emanating from spray head 57 will suddenly turn from a warm condition to a cold condition.

When the total flow through spray head 57 is approximately equivalent to the capacity of chamber means 30, the flow through spray head 57 is automatically discontinued. The person is thus alerted to the need for temporarily discontinuing usage of the bidet apparatus until heater 49 has time to achieve a warm water condition in chamber means 30.

Figure 12:
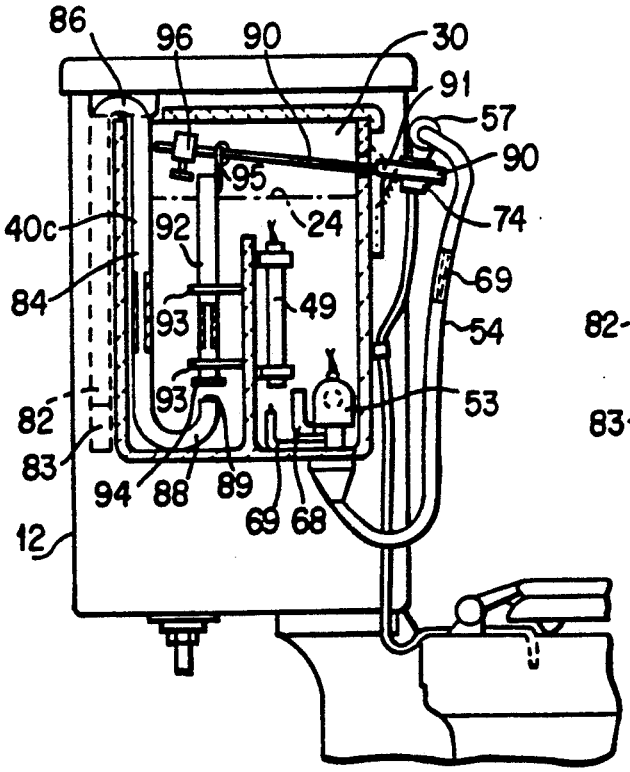
FIG. 12 is a sectional view, similar to the view of FIG. 2, showing another embodiment of the invention.
Figure 13:
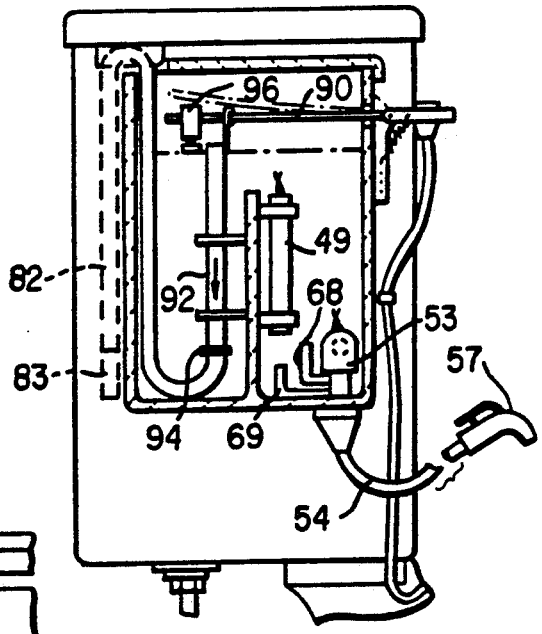
FIG. 13 is a view like that of FIG. 12, showing a spray head in a different position.

FIGS. 12 and 13 show one form of the water temperature control mechanism. The passage structure 40*c* includes a U-tube having one leg 82 extending into the toilet tank 12, a second leg 84 extending within chamber means 30, and a U-shaped section 86 joining the two legs. The general arrangement may be similar to the arrangement shown in FIG. 10. The lower end portion of leg 82 is upturned at 83 and the lower end portion of leg 84 is upturned at 88 to form a discharge opening 89 for admitting water into chamber means 30. The upturned leg portions 83 and 88 of the two legs and the level of their openings cooperate to maintain a siphon action.

With the arrangement illustrated in FIG. 12, the toilet tank and chamber means 30 will have a common water level, such as water level 24, so long as opening 89 is in open communication with chamber means 30, and there is no outflow of warm water through flexible conduit 54 and spray head 57. FIG. 12 shows opening 89 in open communication with chamber means 30. Spray head 57 is shown supported in a holder mechanism 74 so that water level 24 is maintained.

Holder mechanism 74 is a funnel-shaped element similar to the funnel structure 74 shown in FIG. 1. However, the FIG. 12 funnel structure is carried on one end of a lever 90 which has a pivotal connection 91 with one wall of chamber means 30. Lever 90 extends freely through a clearance opening in the chamber wall.

A vertically slidable valve element 92 is slidably supported in bracket arms 93 for movement toward and away from the discharge opening 89. The lower end of valve element 92 is defined by a flat disc or plate 94. Valve element 92 can assume a normally-open raised position, shown in FIG. 12, or a lowered closed position, shown in FIG. 13. When the valve element 92 is in the FIG. 13 position, no water can flow from passage structure 40*c* into chamber means 30.

Valve element 92 is automatically moved to its closed position of FIG. 13 when spray head 57 is lifted out of funnel-type holder 74. A link 95 extends from valve element 92 upwardly and about lever 90. The lever has a rod-shaped cross section, whereas the upper end of the link comprises an eye structure encircling the rod section. As the spray head 57 is removed from funnel holder 74, the weight of valve element 92 plus the additional weight of an add-on weight 96, moves the valve element to the closed position of FIG. 13.

With the components in the FIG. 13 condition, spray head 57 is manually operable to direct warm water through nozzle opening 59. However, valve element 92 will prevent new water from entering into chamber means 30. When the person has exhausted warm water through spray head 57 until level 24 is lowered below the intake port for pump 53, the pump will no longer receive water. The person is alerted to the need for additional warm water by the fact that the flow through nozzle opening 59 has ceased.

New water will flow through passage structure 40*c* when spray head 57 is replaced in funnel 74. the weight of the spray head and associated flexible conduit 54 will automatically tilt lever 90 to the FIG. 12 condition, and new water will be introduced through opening 89.

Figure 15:
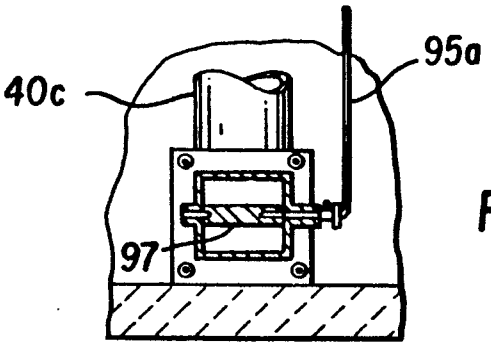
FIG. 15 is a sectional view taken on line 15—15 in FIG. 14.
Figure 16:
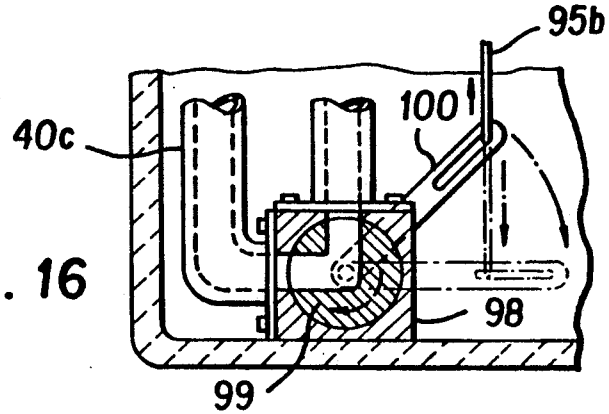
FIG. 16 is a view like that of FIG. 14, illustrating a different valve construction which may be utilized with the invention.
Figure 14:
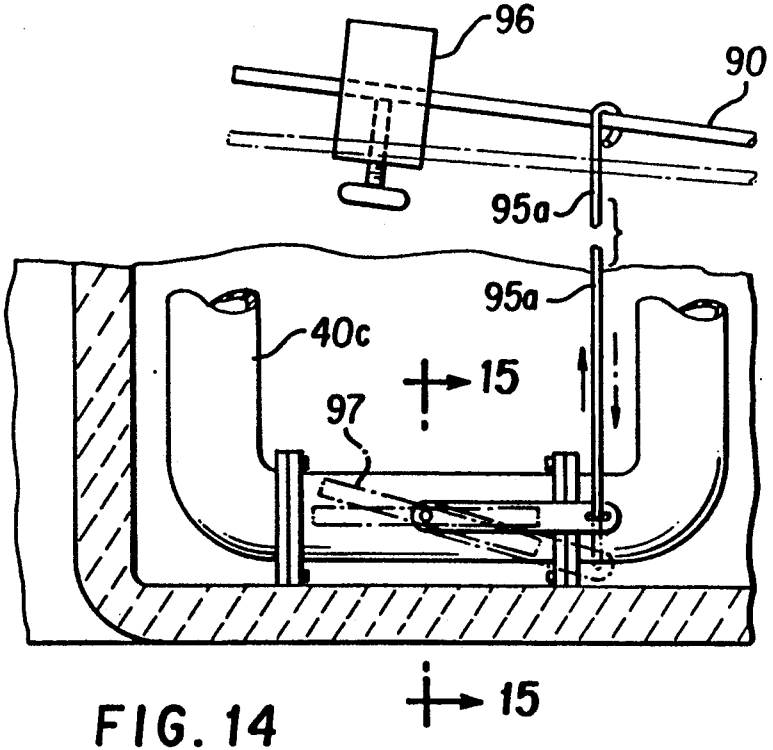
FIG. 14 is an enlarged fragmentary view of a lever-operated valve element which may be utilized as an alternative to the valve element of FIGS. 12 and 13.

FIGS. 14 through 16 illustrate other forms of the normally-open automatic valve element. As shown in FIGS. 14 and 15, a butterfly valve element 97 is pivotably supported in a horizontal section of the passage structure 40*c* for swinging motion about a horizontal axis in proximity to the bottom wall of chamber means 30. An elongated rod-like link 95*a* connects the valve element to the operating lever 90.

FIG. 16 shows an arrangement wherein the passage structure 40*c* comprises a plug valve housing 98. A rotary plug valve element 99 is disposed within housing 98 for rotary swinging movement between open and closed positions. A link 100 is provided between the valve element and the operating rod or link 95*b*. The upper end of link 95*b* is connected to the operating lever 90 (as shown in FIG. 14).

Figure 17:
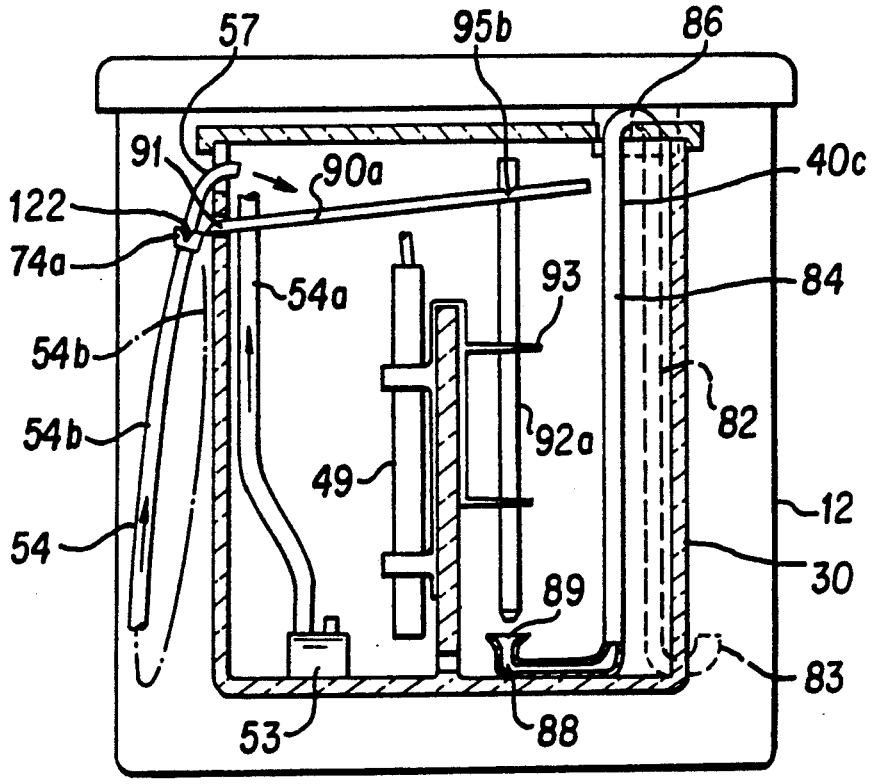
FIG. 17 is a view like that of FIG. 12, illustrating another form of the invention.
Figure 18:
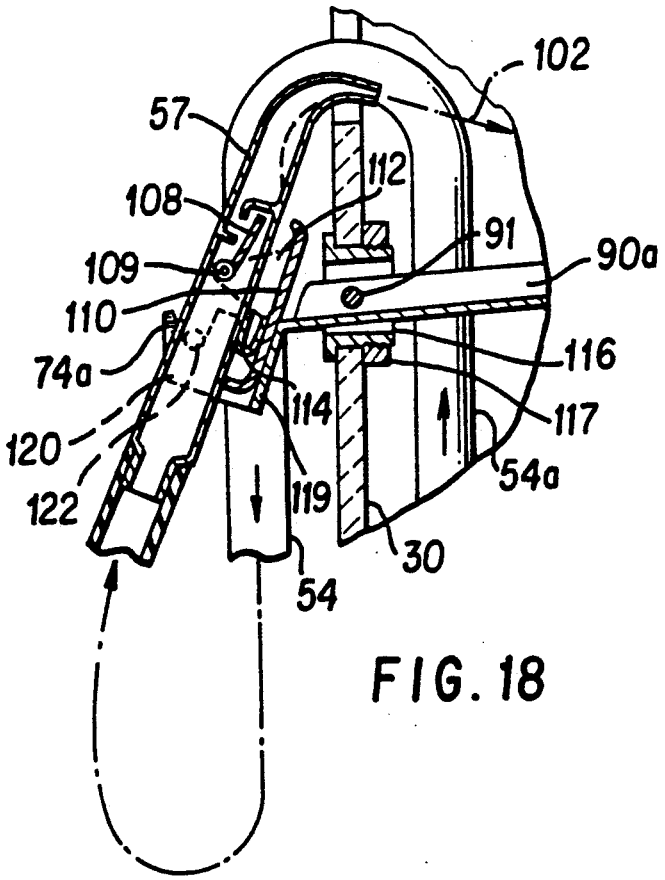
FIG. 18 is an enlarged fragmentary view of a spray head holder structure utilized in the FIG. 17 assembly.

Another form of the system of FIG. 12 is illustrated in FIGS. 17 and 18. In this form of the invention, there is no reverse flow tube 69 within the flexible conduit 54. The water recirculation feature is instead provided by discharge of heated water through spray head 57 when the spray head is supported in a holdermechanism 74*a*. The heated water is discharged into the chamber 30 from the spray head, as indicated by arrow 102 (FIG. 18).

In the arrangement of FIGS. 17 and 18, the flexible conduit 54 has a section 54*a* extending from the motor-operated pump 53 upwardly within chamber means 30, and an external conduit section 54*b* extending outside the chamber means. An opening is defined in the wall of chamber means 30 to accommodate the conduit.

Spray head 57 includes an internal valve element 108 attached to an actuating shaft 109. An actuating handle or lever 110 has two ears 112 connected to shaft 109 to actuate valve element 102 to an open condition when manual squeeze force is applied to the handle. A leaf spring 114 normally biases handle 110 counterclockwise to its closed condition.

A spray head holder 74*a* is attached to an elongated lever 90*a* to hold spray head 57 in its storage position of FIG. 18. Lever 90*a* may be an elongated channel member extending through a hollow cylindrical mounting member 116. A nut 117 may be used to hold member 116 in an opening in the wall of chamber means 30. A transverse pin 91 extends through lever 90*a* and aligned holes in member 116 to provide a pivotal connection between the lever and the chamber wall.

Holder 74*a* comprises a U-shaped seat which has a central web wall 119 and two laterally spaced ears 120 extending therefrom alongside the space to be occuppied by spray head 57. Each ear 120 has a triangular notch defined in its upper edge. Spray head 57 has two cylindrical pins 122 extending outwardly from its side surfaces for disposition within the notches in ears 120.

With spray head 57 placed in holder 74*a*, pins 122 extend into notches 122. The pins serve as pivots, such that the weight of flexible conduit section 54*b* automatically positions the spray head with handle 110 in pressure engagement with web wall 119. This action depresses handle 110 to the flow-open condition. Consequently, when spray head 57 is supported in holder 74*a*, there is automatic recirculation of water through conduit 54 and spray head 57 back into chamber means 30. An opening is formed in the upper edge of the chamber wall to accommodate the discharge end of spray head 57 when it is seated in holder 74*a*.

When the spray head is lifted from holder 74*a*, spring 114 automatically biases handle 119 to the closed, no-flow condition. However, the handle can be manually depressed to the flow open position whenever it is desired to perform a bidet cleansing operation.

The mechanism for supplying water to chamber means 30 is similar to that of FIGS. 12 and 13. The water supply mechanism comprises a U-tube which has one leg 82 extending into toilet tank 12, a second leg 84 extending within chamber means 30, and a U-shaped tube section 86 joining the two legs. The lower end of leg 82 is upturned at 83, and the lower end portion of leg 84 is upturned at 88 to form a discharge opening 89 for admitting water into chamber means 30. Upturned end portion 88 is flared into a frustoconical funnel configuration to form a valve seat for sealably receiving the lower closed end of a slidable tube 92*a*. Tube 92*a* constitutes a valve element for preventing water flow out of tube end portion 88 when tube 92*a* is lowered into engagement with the funnel-shaped valve seat. The openings in upturned leg portions 83 and 88 are at the same level in order to maintain a siphon action from tank 12 to chamber means 30.

Tubular valve member 92*a* extends upwardly through guide bracket to a pivotal connection with lever 90*a*. The tubular member may extend through a clearance opening in the web of the lever channel, with pivot pins extending outwardly into notches 95*b* in the channel flanges. Swing motion of lever 90*a* about pivot 91 produces vertical motion of tube 92*a*.

In most respects, the device of FIG. 17 operates in the same manner as the FIG. 12 construction. The water recirculation action is somewhat different in that spray head 57 discharges into the chamber 30, and tube 69 is not utilized in the FIG. 17 arrangement.

Thus, there has been shown and described a novel bidet apparatus which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. In association with a toilet bowl and water tank, the improvement comprising:

an upstanding water chamber positioned alongside the tank, passage means from the tank to the chamber, whereby a predetermined water level is maintained in the chamber, electric means for heating the water in the chamber, a pump for pumping heated water out of the chamber, a flexible conduit having one end thereof connected to the pump to receive the pump output, a spray head connected to the other end of the flexible conduit, a manual valve in the spray head, and means for recirculating heated water from the spray head back through the flexible conduit into the water chamber.

2. The improvement of claim 1, wherein the heating means and pump operate continuously.

3. The improvement of claim 1, wherein the passage means is a one-way passage means, whereby water in the chamber cannot return to the tank.

4. The improvement of claim 1, wherein the heating means is an elongated cylindrical immersion heater arranged vertically in the water chamber.

5. The improvement of claim 1, wherein the pump is located in a lower portion of the chamber and the flexible conduit extends downwardly from the chamber bottom wall.

6. In association with a toilet that includes a toilet bowl, a water tank elevated above the bowl, a cold water supply pipe connected to the tank, a manually-operated valve permitting water to be gravitationally discharged from the tank into the bowl for flushing and cleaning said bowl, and float means in the tank water level when the tank is not discharging water into the bowl, the improvement comprising a bidet apparatus including:

water chamber means positioned alongside the water tank, passage means extending between the tank and the chamber means for maintaining a common water level in the tank and chamber means, means for heating the water in the chamber means, a hand-operated spray head having a manual valve therein for controlling water flow therethrough, a flexible conduit extending from the chamber means to the spray head, whereby hand-actuation of the manual valve enables heated water to be discharged from the spray head, a pump in the chamber means, the pump including an inlet communicating with the chamber means, and an outlet connected to one end of the flexible conduit to move heated water through the flexible conduit to the spray head, and a water recirculation tube extending along the flexible conduit from a point near the spray head to the water space defined by the chamber means, whereby when the spray head valve is closed heated water flowing along the flexible conduit is automatically returned through the recirculation tube to the chamber means.

7. The improvement of claim 6, wherein the water recirculation tube extends within the flexible conduit.

8. The improvement of claim 6, wherein the water pump is located in a lower portion of the chamber means immediately above the chamber means bottom wall, the connection between the pump outlet and flexible conduit comprising an annular fitting extending through the chamber means bottom wall, said flexible conduit being attached to the lower exposed end of the annular fitting, said water recirculation tube being located within the flexible conduit, one wall of said annular fitting having an opening therethrough for accommodating a section of the recirculation tube, whereby the tube is enabled to discharge water into the chamber means.

9. The improvement of claim 6, wherein the heating means is an immersion heater, the discharge end of the water recirculation tube being located in near proximity to the immersion heater, whereby the water surrounding the heater is in constant movement.

10. The improvement of claim 6, wherein the pump operates continuously to provide a continuous flow of heated water through the flexible conduit and recirculation tube.

11. For use with a toilet that includes a toilet bowl, a water tank elevated above the bowl, a cold water supply pipe connected to the tank, a manually-operated valve permitting water to be discharged by gravity from the tank into the bowl for flushing said bowl, and float means in the tank for maintaining a predetermined tank water level when the tank is not discharging water into the bowl, a bidet apparatus including:

water chamber means adjacent to the water tank, passage means extending between the tank and the chamber means for maintaining a common water level in the tank and chamber means, means for heating the water in the chamber means, a hand-operated spray head having a manual valve for controlling water flow therethrough, a flexible conduit between the chamber means and the spray head, whereby manual actuation of the manual valve causes heated water to be discharged from the spray head, and a pump disposed in the chamber means and including an inlet communicating with the chamber means and an outlet communicating with one end of the flexible conduit to move heated water through the flexible conduit to the spray head, a holder mechanism mounted on said chamber means for suspending said spray head in a storage non-use position adjacent to the chamber means, normally open valve means within the chamber means for controlling inflow of water through said passage means into the chamber means, and means responsive to manual lifting of the spray head from said holder mechanism to automatically operate the valve means into a flow-blocking position.

12. The improvement of claim 11, wherein:

said lifting-responsive means comprises a lever pivotally connected with the chamber means, said holder mechanism being on one end of said lever outside the chamber means, said valve means further including a valve element connected to the other end of the lever, whereby when the spray head is removed from the holder mechanism the lever undergoes pivotal motion to operate the valve element.

13. The improvement of claim 12, wherein:

said valve element is slidably mounted for vertical motion within the chamber means.

14. The improvement of claim 12, wherein:

said valve element is pivotably mounted within the chamber means for swinging motion about a horizontal axis in proximity to the bottom wall of the chamber means.

15. The improvement of claim 14, wherein:

said valve element is a rotary plug valve element.

16. The improvement of claim 12, wherein:

said responsive means further includes a weight carried on said lever within the chamber means.

17. The improvement of claim 12, wherein:

said valve means comprises:

an end portion of said passage means and an end portion of said valve element adapted for mutual engagement to close the normally open valve means.

18. The improvement of claim 17, wherein one of said end portions is flared to receive the other end portion.

19. The improvement according to claim 11, wherein:

the spray head normally closed valve is operated in its flow-open condition upon the positioning of the spray head holder mechanism, whereby continuous spray from the spray head into the chamber means is provided.

20. The improvement according to claim 19, wherein:

the chamber means has an opening in a wall thereof, the spray head positioned on the holder mechanism has its discharge end of the spray head extending through said opening, and the spray head has a handle in engagement with a wall portion of said opening about to depress the handle to place said valve in its flow-open condition.

21. The improvement according to claim 20, and further including:

bias means to maintain the valve in a normally closed no-flow condition when the spray head is not mounted on the holder mechanism.

22. In association with a toilet that includes a toilet bowl, a water tank elevated above the bowl, a cold water supply pipe connected to the tank, and float means in the tank for maintaining a predetermined tank water level when the tank is not discharging water into the bowl, the improvement comprising a bidet apparatus including:

water chamber means adjacent to the water tank, passage means extending between the tank and the chamber means for maintaining a common water level in the tank and chamber means, means for heating the water in the chamber means, a hand-operated spray head having a manual valve therein for controlling water flow therethrough, a flexible conduit extending from the chamber means to the spray head, whereby hand-actuation of the manual valve enables heated water to be discharged from the spray head, a pump in the chamber means, the pump including an inlet communicating with the chamber means and an outlet connected to one end of the flexible conduit to move heated water through the flexible conduit to the spray head, and a water recirculation tube extending along the flexible conduit from a point near the spray head to the water space defined by the chamber means, whereby when the spray head valve is closed heated water flowing along the flexible conduit is automatically returned through the recirculation tube to the chamber means.

23. The improvement of claim 22, wherein:

the water recirculation tube extends within the flexible conduit.

24. The improvement of claim 22, wherein:

said chamber means is separately formed from the water tank so that the chamber means can be attached to the tank or removed from the tank.

25. The improvement of claim 22, wherein:

the water chamber means is integrally formed with the water tank so that the tank and chamber means have a common wall therebetween, and said passage means comprises an opening extending through said common wall at an elevated point thereon, whereby a water level is maintained in the chamber means during a bowl-flushing operation.

26. The improvement of claim 22, wherein:

the pump operates continuously to provide a continuous flow of heated water through the flexible conduit and recirculation tube.

27. In association with a toilet bowl and water tank, the improvement comprising a bidet apparatus that includes:

upstanding water chamber means positioned alongside the tank, passage means from the tank to the chamber means, whereby a predetermined water level is maintained in the chamber, electric means for heating the water in the chamber, a pump for pumping heated water out of the chamber, a flexible conduit having one end thereof connected to the pump to receive the pump output, a hand-operated spray head connected to the other end of the flexible conduit, a manual valve in the spray head, a holder mechanism mounted on said water chamber means for suspending said spray head in a storage non-use position adjacent to the chamber means, and means for recirculating heated water from the spray head into the water chamber when the spray head is in its storage non-use position.

28. The improvement of claim 27, wherein:

said water recirculating means comprises a water recirculation tube extending along the flexible conduit from a point near the spray head to the water chamber.

29. The improvement of claim 27, wherein:

said water recirculating means comprises means responsive to placement of the spray head into the holder mechanism to hold the manual valve in an open position, whereby water flows through the spray head directly into the water chamber.

30. The improvement of claim 27, wherein:

said water recirculating means comprises a water recirculation tube extending within the flexible conduit from a point near the spray head to the water chamber.

31. The improvement of claim 27, wherein:

said passage means comprises a hollow bolt extending through the bottom wall of the tank and a subjacent wall of the toilet bowl, and a nut threaded onto the lower end of the bolt, whereby the nut-bolt assembly acts as a passage component and also as a connector means for attaching the tank to the bowl.

32. The improvement of claim 31, wherein:

said bolt includes a tubular section extending below the nut, and said passage means includes a hose having an end portion thereof connected to the tubular section of the bolt, whereby water can flow from the tank through the bolt into the hose.

33. The improvement of claim 27, wherein:

the heating means and pump operate continuously, whereby heated water is continuously recirculated from the spray head into the water chamber when the spray head is in its storage non-use position.

* * * * *